US005489346A

United States Patent [19]

Erickson

[11] Patent Number: 5,489,346

[45] Date of Patent: Feb. 6, 1996

[54] HOT CORROSION RESISTANT SINGLE CRYSTAL NICKEL-BASED SUPERALLOYS

[75] Inventor: Gary L. Erickson, Muskegon, Mich.

[73] Assignee: SPS Technologies, Inc., Jenkintown, Pa.

[21] Appl. No.: 237,510

[22] Filed: May 3, 1994

[51] Int. Cl.[6] ..... C22C 19/05

[52] U.S. Cl. ..... 148/404; 148/428; 420/448

[58] Field of Search ..... 148/404, 428; 420/448

[56] References Cited

U.S. PATENT DOCUMENTS

| | | | |
|---|---|---|---|
| 4,207,098 | 6/1980 | Shaw | 75/171 |
| 4,582,548 | 4/1986 | Harris et al. | 148/404 |
| 4,643,782 | 2/1987 | Harris et al. | 148/404 |
| 4,677,035 | 6/1987 | Fiedler et al. | 428/680 |
| 4,885,216 | 12/1989 | Naik | 428/680 |
| 4,957,703 | 9/1990 | Lawrence et al. | 420/448 |
| 5,069,873 | 12/1991 | Harris et al. | 420/448 |
| 5,154,884 | 10/1992 | Wukusick et al. | 148/404 |

FOREIGN PATENT DOCUMENTS 2153848 8/1985 United Kingdom .

OTHER PUBLICATIONS

"Phacomp Revisited", by H. J. Murphy, C. T. Sims and A. M. Beltran, vol. 1, Int. Symposium on Structural Stability in Superalloys (1968).

"Superalloy Developments for Aero and Industrial Gas Turbines" by G. L. Erickson, Reprint ASM International, Mar. 1994.

"Polycrystalline Cast Superalloys", by Gary L. Erickson, Reprint–Metals Handbook, vol. 1, 10th Edition: Properties and Selection (1989).

"Development of a New Single Crystal Superalloy for Industrial Gas Turbine Blades", by T. Khan and P. Caron, High Temperature Materials for Power Engineering 1990, Part II (Sep. 1990).

*Primary Examiner*—Deborah Yee
*Attorney, Agent, or Firm*—James D. Dee

[57] ABSTRACT

This invention relates to a hot corrosion resistant nickel-based superalloy comprising the following elements in percent by weight: from about 11.5 to about 13.5 percent chromium, from about 5.5 to about 8.5 percent cobalt, from about 0.40 to about 0.55 percent molybdenum, from about 4.5 to about 5.5 percent tungsten, from about 4.5 to about 5.8 percent tantalum, from about 0.05 to about 0.25 percent columbium, from about 3.4 to about 3.8 percent aluminum, from about 4.0 to about 4.4 percent titanium, from about 0.01 to about 0.06 percent hafnium, and the balance nickel plus incidental impurities, the superalloy having a phasial stability number $N_{V3B}$ less than about 2.45. Single crystal articles can be suitably made from the superalloy of this invention. The article can be a component for a gas turbine engine and, more particularly, the component can be a gas turbine blade or gas turbine vane.

20 Claims, 7 Drawing Sheets

HOT CORROSION TEST CONDITIONS

| | | | |
|---|---|---|---|
| 1 | TEMPERATURE,TIME | 1050 ℃–500 hrs (max) | |
| 2 | BURNING GAS FLOW RATE | 6Nm2/min | SOx :257~287 ppm |
| 3 | PETROLEUM FLOW RATE | 18ℓ/min | NaCl :17.8~18.2 mg/m2n |
| 4 | NaCL SOLUTION | 6cc/min | Na2SO4 :<0.5 mg/m2n |
| 5 | SULPHURIC OIL | 7cc/min | |

OXIDATION TEST CONDITIONS

1 TEMPERATURE,TIME 1200 ℃–500 hrs (max)
2 BURNING GAS FLOW RATE 6Nm$^2$/min
3 PETROLEUM FLOW RATE 18~20ℓ/min
4 BURNING PRESSURE 11 kgf/cm$^2$

HOT CORROSION RESISTANT SINGLE CRYSTAL NICKEL-BASED SUPERALLOYS

BACKGROUND OF THE INVENTION

1. Field of the Invention

This invention relates to single crystal nickel-based superalloys and, more particularly, single crystal nickel-based superalloys and articles made therefrom having increased resistance to bare hot corrosion for use in gas turbine engines.

2. Description of the Prior Art

Advances over recent years in the metal temperature and stress capability of single crystal articles have been the result of the continuing development of single crystal superalloys, as well as improvements in casting processes and engine application technology. These single crystal superalloy articles include rotating and stationary turbine blades and vanes found in the hot sections of gas turbine engines. Gas turbine engine design goals have remained the same during the past decades. These goals include the desire to increase engine operating temperature, rotational speed, fuel efficiency, and engine component durability and reliability.

Prior art attempts to provide alloys to help achieve these design goals for industrial gas turbine engine applications include U.S. Pat. No. 4,677,035, Fiedler et al., which discloses a nickel-base single crystal alloy composition consisting essentially of, in percent by weight, 8.0–14.0% chromium, 1.5–6.0% cobalt, 0.5–2.0% molybdenum, 3.0–10.0% tungsten, 2.5–7.0% titanium, 2.5–7.0% aluminum, 3.0–6.0% tantalum, and the balance nickel. However, the alloy compositions taught by this reference, while possessing relatively high strength at prolonged or repeated exposure to high temperatures, are susceptible to the accelerated corrosive effect of the hot gas environment in which components fabricated from the alloys are exposed to when used in gas turbines.

Also, U.K. Patent Application Publication No. 2153848A discloses nickel-base alloys having a composition within the range of 13–15.6% chromium, 5–15% cobalt, 2.5–5% molybdenum, 3–6% tungsten, 4–6% titanium, 2–4% aluminum, and the balance essentially nickel without intentional additions of carbon, boron or zirconium, which are fabricated into single crystals. Although the alloys taught by this reference claim an improvement in hot corrosion resistance accompanied by an increase in creep rupture properties, the need remains in the art for single crystal superalloys for industrial gas turbine applications having a superior combination of increased hot corrosion resistance, oxidation resistance, mechanical strength, large component castability and adequate heat treatment response.

Single crystal articles are generally produced having the low-modulus (001) crystallographic orientation parallel to the component dendritic growth pattern or blade stacking axis. Face-centered cubic (FCC) superalloy single crystals grown in the (001) direction provide extremely good thermal fatigue resistance relative to conventionally cast polycrystalline articles. Since these single crystal articles have no grain boundaries, alloy design without grain boundary strengtheners, such as carbon, boron and zirconium, is possible. As these elements are alloy melting point depressants, their essential elimination from the alloy design provides a greater potential for high temperature mechanical strength achievement since more complete gamma prime solution and microstructural homogenization can be achieved relative to directionally solidified (DS) columnar grain and conventionally cast materials, made possible by a higher incipient melting temperature.

These process benefits are not necessarily realized unless a multi-faceted alloy design approach is undertaken. Alloys must be designed to avoid tendency for casting defect formation such as freckles, slivers, spurious grains and recrystallization, particularly when utilized for large cast components. Additionally, the alloys must provide an adequate heat treatment "window" (numeric difference between an alloy's gamma prime solvus and incipient melting point) to allow for nearly complete gamma prime solutioning. At the same time, the alloy compositional balance should be designed to provide an adequate blend of engineering properties necessary for operation in gas turbine engines. Selected properties generally considered important by gas turbine engine designers include: elevated temperature creep-rupture strength, thermo-mechanical fatigue resistance, impact resistance, hot corrosion and oxidation resistance, plus coating performance. In particular, industrial turbine designers require unique blends of hot corrosion and oxidation resistance, plus good long-term mechanical properties.

An alloy designer can attempt to improve one or two of these design properties by adjusting the compositional balance of known superalloys. However, it is extremely difficult to improve more than one or two of the design properties without significantly or even severely compromising some of the remaining properties. The unique superalloy of the present invention provides an excellent blend of the properties necessary for use in producing single crystal articles for operation in industrial and marine gas turbine engine hot sections.

SUMMARY OF THE INVENTION

This invention relates to a hot corrosion resistant nickel-based superalloy comprising the following elements in percent by weight: from about 11.5 to about 13.5 percent chromium, from about 5.5 to about 8.5 percent cobalt, from about 0.40 to about 0.55 percent molybdenum, from about 4.5 to about 5.5 percent tungsten, from about 4.5 to about 5.8 percent tantalum, from about 0.05 to about 0.25 percent columbium, from about 3.4 to about 3.8 percent aluminum, from about 4.0 to about 4.4 percent titanium, from about 0.01 to about 0.06 percent hafnium, and the balance nickel plus incidental impurities, the superalloy having a phasial stability number $N_{V3B}$ less than about 2.45.

Advantageously, the sum of aluminum plus titanium in this superalloy composition is from 7.4 to 8.2 percent by weight. Also, it is advantageous to have a Ti:Al ratio greater than 1 and a Ta:W ratio greater than 1 in the composition of the present invention. Although incidental impurities should be kept to the least amount possible, the superalloy can also be comprised of from about 0 to about 0.05 percent carbon, from about 0 to about 0.03 percent boron, from about 0 to about 0.03 percent zirconium, from about 0 to about 0.25 percent rhenium, from about 0 to about 0.10 percent silicon, and from about 0 to about 0.10 percent manganese. In all cases, the base element is nickel. This invention provides a single crystal superalloy having an increased resistance to hot corrosion, an increased resistance to oxidation, and increased creep-rupture strength.

Single crystal articles can be suitably made from the superalloy of this invention. The article can be a component for a gas turbine engine and, more particularly, the component can be a gas turbine blade or gas turbine vane.

The superalloy compositions of this invention have a critically balanced alloy chemistry which results in a unique blend of desirable properties, including an increased resistance to hot corrosion, which are particularly suitable for industrial and marine gas turbine applications. These properties include: excellent bare hot corrosion resistance and creep-rupture strength; good bare oxidation resistance; good single crystal component castability, particularly for large blade and vane components; good solution heat treatment response; adequate resistance to cast component recrystallization; adequate component coatability and microstructural stability, such as long-term resistance to the formation of undesirable, brittle phases called topologically close-packed (TCP) phases.

Accordingly, it is an object of the present to provide superalloy compositions and single crystal articles made therefrom having a unique blend of desirable properties, including increased hot corrosion resistance. It is a further object of the present invention to provide superalloys and single crystal articles made therefrom for use in industrial and marine gas turbine engines. These and other objects and advantages of the present invention will be apparent to those skilled in the art upon reference to the following description of the preferred embodiments.

DESCRIPTION OF THE PREFERRED EMBODIMENTS

Figure 1:
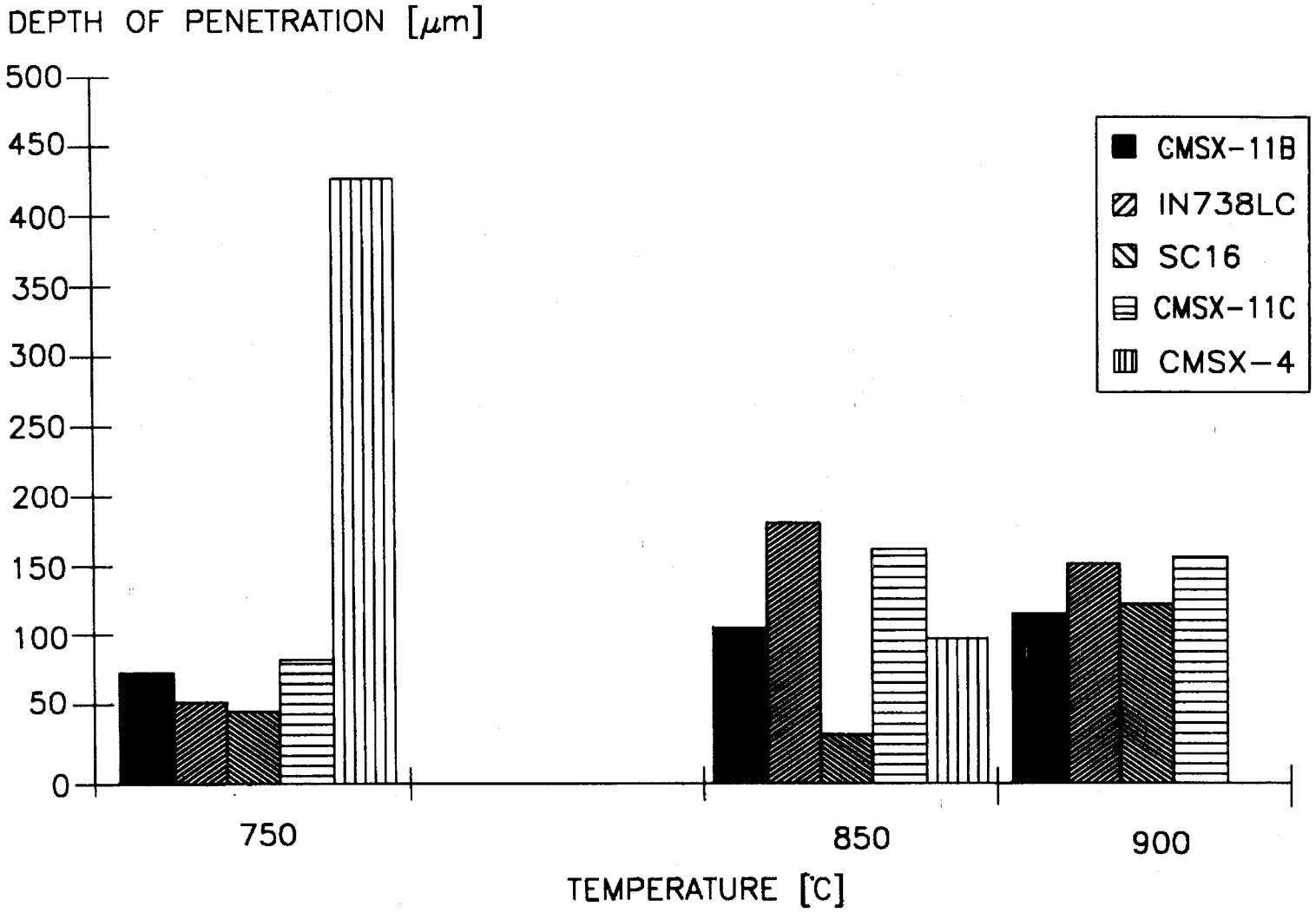
FIG. 1 is a chart of hot corrosion test results performed at three exposure temperatures on one embodiment of this invention and on four other alloys.

The hot corrosion resistant nickel-based superalloy of the present invention comprises the following elements in percent by weight:

| | |
|---|---|
| Chromium | about 11.5–13.5 |
| Cobalt | about 5.5–8.5 |
| Molybdenum | about 0.40–0.55 |
| Tungsten | about 4.5–5.5 |
| Tantalum | about 4.5–5.8 |
| Columbium | about 0.05–0.25 |
| Aluminum | about 3.4–4.8 |
| Titanium | about 4.0–4.4 |
| Hafnium | about 0.01–0.06 |
| Nickel + Incidental Impurities | balance |

This superalloy composition also has a phasial stability number $N_{V3B}$ less than about 2.45. Further, this invention has a critically balanced alloy chemistry which results in a unique blend of desirable properties useful for industrial and marine gas turbine engine applications. These properties include a superior blend of bare hot corrosion resistance and creep-rupture strength relative to prior art single crystal superalloys for industrial and marine gas turbine applications, bare oxidation resistance, single crystal component castability, and microstructural stability, including resistance to TCP phase formation under high stress, high temperature conditions.

Superalloy chromium content is a primary contributor toward attaining superalloy hot corrosion resistance. The superalloys of the present invention have a relatively high chromium content since alloy hot corrosion resistance was one of the primary design criteria in the development of these alloys. The chromium is about 11.5–13.5% by weight. Advantageously, the chromium content is from 12.0% to 13.0% by weight. Although chromium provides hot corrosion resistance, it may also assist with the alloys' oxidation capability. Additionally, this superalloys' tantalum and titanium contents, as well as its Ti:Al ratio being greater than 1, are beneficial for hot corrosion resistance attainment. However, besides lowering the alloys' gamma prime solvus, chromium contributes to the formation of Cr and W-rich TCP phase and must be balanced accordingly in these compositions.

In one embodiment of the present invention, the cobalt content is about 5.5–8.5% by weight. In another embodiment of the present invention, the cobalt content is from 6.2% to 6.8% by weight. The chromium and cobalt levels in these superalloys assist in making the superalloy solution heat treatable, since both elements tend to decrease an alloy's gamma prime solvus. Proper balancing of these elements in the present invention in tandem with those which tend to increase the alloy's incipient melting temperature, such as tungsten and tantalum, result in superalloy compositions which have desirable solution heat treatment windows (numerical difference between an alloy's incipient melting point and its gamma prime solvus), thereby facilitating full gamma prime solutioning. The cobalt content is also beneficial to the superalloy's solid solubility.

The tungsten content is about 4.5–5.5% by weight and, advantageously, the amount of tungsten is from 4.7% to 5.3% by weight. Tungsten is added in these compositions since it is an effective solid solution strengthener and it can contribute to strengthening the gamma prime. Additionally, tungsten is effective in raising the alloy's incipient melting temperature.

Similar to tungsten, tantalum is a significant solid solution strengthener in these compositions, while also contributing to enhanced gamma prime particle strength and volume fraction. The tantalum content is about 4.5–5.8% by weight and, advantageously, the tantalum content is from 4.9% to 5.5% by weight. In these compositions, tantalum is beneficial since it helps to provide bare hot corrosion and oxidation resistance, along with aluminide coating durability. Additionally, tantalum is an attractive single crystal alloy additive in these compositions since it assists in preventing "freckle" defect formation during the single crystal casting process particularly when present in greater proportion than tungsten (i.e., the Ta:W ratio is greater than 1). Furthermore, tantalum is an attractive means of strength attainment in these alloys since it is believed not to directly participate in TCP phase formation.

The molybdenum content is about 0.40–0.55% by weight. Advantageously, molybdenum is present in an amount of from 0.42% to 0.48% by weight. Molybdenum is a good solid solution strengthener, but it is not as effective as tungsten and tantalum, and it tends to be a negative factor toward hot corrosion capability. However, since the alloy's density is always a design consideration, and the molybdenum atom is lighter than the other solid solution strengtheners, the addition of molybdenum is a means of assisting control of the overall alloy density in the compositions of this invention. It is believed that the relatively low molybdenum content is unique in this class of bare hot corrosion resistant nickel-based single crystal superalloys.

The aluminum content is about 3.4–3.8% by weight. Furthermore, the amount of aluminum present in these compositions is advantageously from 3.5% to 3.7% by weight. Aluminum and titanium are the primary elements comprising the gamma prime phase, and the sum of aluminum plus titanium in the present invention is from 7.4 to 8.2 percent by weight. These elements are added in these compositions in a proportion and ratio consistent with achieving adequate alloy castability, solution heat treatability, phasial stability and the desired blend of high mechanical strength and hot corrosion resistance. Aluminum is also added to these alloys in proportions sufficient to provide oxidation resistance.

The titanium content is about 4.0–4.4% by weight. Advantageously, titanium is present in this composition in an amount from 4.1% to 4.3% by weight. These alloys' titanium content is relatively high and, therefore, is beneficial to the alloys' hot corrosion resistance. However, it can also have a negative effect on oxidation resistance, alloy castability and alloy response to solution heat treatment. Accordingly, it is critical that the titanium content is maintained within the stated range of this composition and the proper balancing of the aforementioned elemental constituents is maintained. Furthermore, maintaining the alloys' Ti:Al ratio greater than 1 is critical in achieving the desired bare hot corrosion resistance in these compositions.

The columbium content is about 0.05%–0.25% by weight and, advantageously, the columbium content is from 0.05% to 0.12% by weight. Columbium is a gamma prime forming element and it is an effective strengthener in the nickel-based superalloys of this invention. Generally, however, columbium is a detriment to alloy oxidation and hot corrosion properties, so its addition to the compositions of this invention is minimized. Moreover, columbium is added to this invention's compositions for the purpose of gettering carbon, which can be chemi-sorbed into component surfaces during non-optimized vacuum solution heat treatment procedures. Any carbon pick-up will tend to form columbium carbide instead of titanium or tantalum carbide, thereby preserving the greatest proportion of titanium and/or tantalum for gamma prime and/or solid solution strengthening in these alloys. Furthermore, it is critical that the sum of columbium plus hafnium is from 0.06 to 0.31 percent by weight in these compositions in order to enhance the strength of these superalloys.

The hafnium content is about 0.01%–0.06% by weight and, advantageously, hafnium is present in an amount from 0.02% to 0.05% by weight. Hafnium is added in a small proportion to the present compositions in order to assist with coating performance and adherence. Hafnium generally partitions to the gamma prime phase.

The balance of this invention's superalloy compositions is comprised of nickel and small amounts of incidental impurities. Generally, these incidental impurities are entrained from the industrial process of production, and they should be kept to the least amount possible in the composition so that they do not affect the advantageous aspects of the superalloy. For example, these incidental impurities may include up to about 0.05 percent carbon, up to about 0.03 percent boron, up to about 0.03 percent zirconium, up to about 0.25 percent rhenium, up to about 0.10 percent silicon, and up to about 0.10 percent manganese. Amounts of these impurities which exceed the stated amounts could have an adverse effect upon the resulting alloy's properties.

Not only does the superalloy of this invention have a composition within the above specified ranges, but it also has a phasial stability number $N_{V3B}$ less than about 2.45. As can be appreciated by those skilled in the art, $N_{V3B}$ is defined by the PWA N-35 method of nickel-based alloy electron vacancy TCP phase control factor calculation. This calculation is as follows:

EQUATION 1

Conversion for weight percent to atomic percent:

$$\text{Atomic percent of element } i = \text{Pi} = \frac{Wi/Ai}{\Sigma i(Wi/Ai)} \times 100$$

where:

Wi=weight percent of element i

Ai=atomic weight of element i

EQUATION 2

Calculation for the amount of each element present in the continuous matrix phase:

| Element | Atomic amount Rii remaining |
|---|---|
| Cr | $R_{Cr} = 0.97P_{Cr} - 0.375P_B - 1.75P_C$ |
| Ni | $R_{Ni} = P_{Ni} + 0.525P_B - 3(P_{AL} + 0.03P_{Cr} + P_{Ti} - 0.5P_C + 0.5P_V + P_{Ta} + P_{Cb} + P_{Hf})$ |
| Ti, Al, B, C, Ta, Cb, Hf | Ri = O |
| V | $Rv = 0.5P_V$ |
| W | $R_{(W)} = P_W - 0.167P_C \frac{P_W}{P_{MO} + P_W}$ |
| Mo | $R_{(MO)} = P_{(MO)} - 0.75P_B - 0.167P_C \frac{P_{MO}}{(P_{MO} + P_W)}$ |

EQUATION 3

Calculation of $N_{v3B}$ using atomic factors from Equations 1 and 2 above:

$$N_i^i = \frac{R_i}{{}_iR_i} \text{ then } N_{v38} = \Sigma_i Ni(N_v)i$$

where:

i=each individual element in turn.

$N_i$i=the atomic factor of each element in matrix.

$(N_v)$i=the electron vacancy No. of each respective element.

This calculation is exemplified in detail in a technical paper entitled "PHACOMP Revisited", by H. J. Murphy, C. T. Sims and A. M. Beltran, published in Volume 1 of International Symposium on Structural Stability in Superalloys (1968), the disclosure which is incorporated by reference herein. As can be appreciated by those skilled in the art, the phasial stability number for the superalloys of this invention is critical and must be less than the stated maximum to provide a stable microstructure and capability for the desired properties under high temperature, high stress conditions. The phasial stability number can be determined empirically, once the practitioner skilled in the art is in possession of the present subject matter.

The superalloys of this invention can be used to suitably make single crystal articles, such as components for industrial and marine gas turbine engines. Preferably, these superalloys are utilized to make a single crystal casting to be used under high stress, high temperature conditions characterized by an increased resistance to hot corrosion (sulfidation) under such conditions, particularly high temperature conditions involving corrosive atmospheres containing sulfur, sodium and vanadium contaminants, up to about 1922° F. (1050° C.). While these superalloys can be used for any purpose requiring high strength castings produced as a single crystal, their particular use is in the casting of single crystal blades and vanes for industrial and marine gas turbine engines.

The single crystal components made from this invention's compositions can be produced by any of the single crystal casting techniques known in the art. For example, single crystal directional solidification processes can be utilized, such as the seed crystal process and the choke process.

The single crystal castings made from the superalloys of the present invention can be aged at a temperature of from about 1800° F. (982° C.) to about 2125° F. (1163° C.) for about 1 to about 50 hours. However, as can be appreciated by those skilled in the art, the optimum aging temperature and time for aging depends on the precise composition of the superalloy.

This invention provides superalloy compositions having a unique blend of desirable properties. These properties include: excellent bare hot corrosion resistance and creep-rupture strength; good oxidation resistance; good single crystal component castability, particularly for large blade and vane components; good solution heat treatment response; adequate resistance to cast component recrystallization; adequate component coatability and microstructural stability, such as long-term resistance to the formation of undesirable, brittle phases called topologically close-packed (TCP) phases. As noted above, this superalloy has a precise composition with only small permissible variations in any one element if the unique blend of properties is to be maintained.

In order to more clearly illustrate this invention and provide a comparison with representative superalloys outside the claimed scope of the invention, the examples set forth below are presented. The following examples are included as being illustrations of the invention and its relation to other superalloys and articles, and should not be construed as limiting the scope thereof.

EXAMPLES

Test materials were prepared to investigate the compositional variations and ranges for the superalloys of the present invention. Some of the alloy compositions tested and reported below fall outside the claimed scope of the present invention, but are included for comparative purposes to assist in the understanding of the invention. Representative alloy aim chemistries of materials tested are reported in Table 1 below.

TABLE 1

| | AIM CHEMISTRIES | | | | | |
|---|---|---|---|---|---|---|
| ELEMENT | CMSX-11 | CMSX-11A | CMSX-11B | CMSX-11B' | CMSX-11B" | CMSX-11C |
| C | LAP | LAP | LAP | LAP | LAP | LAP |
| Cr | 13.0 | 13.0 | 12.5 | 12.3 | 12.1 | 14.5 |
| Co | 7.5 | 6.9 | 6.0 | 5.7 | 6.5 | 3.0 |
| Mo | 0.5 | 0.55 | 0.55 | 0.50 | 0.45 | 0.40 |
| W | 4.9 | 5.0 | 5.0 | 5.1 | 5.2 | 4.4 |
| Ta | 5.0 | 5.15 | 5.15 | 5.15 | 5.45 | 4.95 |
| Cb | 0.40 | 0.34 | 0.20 | 0.10 | 0.10 | 0.10 |
| Al | 3.50 | 3.60 | 3.60 | 3.60 | 3.60 | 3.40 |
| Ti | 4.10 | 4.20 | 4.20 | 4.15 | 4.10 | 4.20 |
| Hf | 0.05 | 0.042 | 0.040 | 0.04 | 0.03 | 0.04 |
| Ni | BAL | BAL | BAL | BAL | BAL | BAL |
| $N_{v38}$ | 2.46 | 2.52 | 2.42 | 2.36 | 2.38 | 2.41 |

NOTE: Chemistries are in wt. %.

Single crystal alloy development to investigate the compositional variations for the superalloys of the present invention began with the definition and evaluation of a series of experimental compositions. The primary objective of the initial development effort was to achieve, with elemental balancing, a combination of increased hot corrosion resistance along with oxidation resistance, mechanical strength, large component castability, and adequate heat treatment response.

The initial developmental alloy iteration, CMSX®-11, was defined with the aim chemistry shown in Table 1 and was subsequently produced as a 250 lb. (113 kg.) heat in a small production-type VIM furnace. (CMSX is a registered trademark of Cannon-Muskegon Corporation, assignee of the present application.) A small quantity of the resulting 3" (76 mm) diameter bar product from heat VF 839 (see Table 2 below) was investment cast to produce sixteen single crystal test bars. Grain and orientation inspections revealed that only two bars exhibited rejectable grain or sliver indications. No freckles were apparent. Furthermore, all bars were within 15° of the desired primary (001) crystallographic orientation.

TABLE 2

| Heat #/Alloy Designation | VIM FURNACE HEAT CHEMISTRIES ELEMENT C | Cr | Co | Mo | W | Ta | Cb ppm | Al | Ti | Hf | Ni | $N_{v3B}$ |
|---|---|---|---|---|---|---|---|---|---|---|---|---|
| VF 839/CMSX-11 | 11 | 12.4 | 7.5 | .52 | 4.9 | 5.0 | .40 | 3.5 | 4.05 | .05 | BAL | 2.39 |
| VF 952/R2D2 | 10 | 11.0 | 4.9 | .49 | 2.5 | 5.0 | <.01 | 3.39 | 3.76 | .05 | BAL | 1.92 |
| VF 999/CMSX-11B | 19 | 12.2 | 6.0 | .56 | 5.0 | 5.2 | .21 | 3.60 | 4.24 | .04 | BAL | 2.40 |
| VG 32/CMSX-11B | 19 | 12.4 | 5.8 | .55 | 5.15 | 5.1 | .19 | 3.58 | 4.20 | .035 | SAL | 2.40 |
| VG 92/CMSX-11B' | 15 | 12.4 | 5.6 | .50 | 5.0 | 5.1 | .10 | 3.64 | 4.14 | .035 | BAL | 2.37 |
| VG 109/CMSX-11B" | 16 | 11.6 | 6.3 | .44 | 5.2 | 5.4 | .10 | 3.62 | 4.09 | .03 | BAL | 2.32 |

NOTE: Chemistries in wt. % unless otherwise indicated

Solution heat treatment procedures developed for the alloy, having a peak temperature of 2305° F. (1263° C.), resulted in complete coarse γ' and eutectic γ–γ' solutioning. Following solution treatment, the bars were aged as reported in Table 3 below.

TABLE 3

| ALLOY | HEAT TREATMENT PEAK SOLUTION TEMP. °F. (°C.) | % SOLUTIONING | AGING TREATMENT |
|---|---|---|---|
| CMSX-11 | 2305 (1263) | 100 | 1975° F./4 Hrs/AC<br>1600° F./20 Hrs/AC<br>1400° F./24 Hrs/AC |
| CMSX-11A | 2293 (1256) | 100 | 1975° F./4 Hrs/AC<br>1600° F./21 Hrs/AC<br>1400° F./43 Hrs/AC |
| CMSX-11B | 2300 (1260) | 100 | 2050° F./5 Hrs/AC<br>1600° F./20 Hrs/AC<br>1400° F./24 Hrs/AC |
| CMSX-11B' | 2307 (1264) | 99.5–100 | 2050° F./5 Hrs/AC<br>1600° F./20 Hrs/AC<br>1400° F./24 Hrs/AC |

TABLE 3-continued

| ALLOY | HEAT TREATMENT PEAK SOLUTION TEMP. °F. (°C.) | % SOLUTIONING | AGING TREATMENT |
|---|---|---|---|
| CMSX-11B" | 2307 (1264) | 99.5–100 | 2050° F./5 Hrs/AC<br>1600° F./20 Hrs/AC<br>1400° F./24 Hrs/AC |

Heat treated test bars were machined and low-stress ground to ASTM standard proportional specimen dimension for subsequent creep-rupture testing at various conditions of temperature and stress, according to standard ASTM procedure.

Table 4 reported below shows the results of creep rupture tests undertaken with the CMSX-11 alloy specimens. The tests were performed at conditions ranging 1400°–1800° F. (760°–982° C.), and the results indicated that this developmental alloy iteration was not as strong as desired. However, microstructural review of the failed rupture specimens revealed that this alloy iteration possessed adequate microstructural stability.

TABLE 4

CREEP-RUPTURE DATA
CMSX-11 Alloy

| TEST CONDITION | RUPTURE TIME HRS | EL % | RA % | FINAL CREEP READING T, HRS | % DEFORMATION | TIME IN HRS TO REACH 1.0% | 2.0% |
|---|---|---|---|---|---|---|---|
| 1400° F./90.0 ksi | 588.3 | 4.5 | 8.3 | 588.2 | 4.213 | 279.6 | 494.5 |
| (760° C./620 MPa) | 502.2 | 3.6 | 7.8 | 500.5 | 3.079 | 210.1 | 423.8 |
| 1600° F./50.0 ksi | 240.5 | 9.5 | 17.5 | 239.4 | 7.756 | 61.3 | 148.9 |
| (871° C./345 MPa) | 205.2 | 8.5 | 13.4 | 203.8 | 8.169 | 61.9 | 113.9 |
| | 201.9 | 9.3 | 15.1 | 201.3 | 6.107 | 81.6 | 135.3 |
| | 223.9 | 10.9 | 15.2 | 222.4 | 8.419 | 68.5 | 130.0 |
| 1700° F./36.0 ksi | 267.4 | 11.1 | 15.6 | 265.1 | 9.221 | 57.1 | 145.9 |
| (927° C./248 MPa) | 235.1 | 12.6 | 19.0 | 233.9 | 9.705 | 66.1 | 132.6 |
| 1800° F./25.0 ksi | 372.7 | 15.2 | 29.2 | 371.8 | 11.938 | 167.1 | 270.5 |
| (982° C./172 MPa) | 395.3 | 19.6 | 30.6 | 395.2 | 15.785 | 105.7 | 255.7 |
| | 302.7 | 13.8 | 30.7 | 301.1 | 9.931 | 106.1 | 200.4 |
| | 216.0 | 9.8 | 14.7 | 215.1 | 7.621 | 100.6 | 163.7 |

+ Machined From Blade Specimen (Airfoil)
++ Machined From Blade Specimen (Transverse Root)

The results of alloy hot corrosion tests undertaken concurrent to the creep-rupture evaluation are reported in Table 5 below. The initial burner rig test which was undertaken at 1650° F. (899° C.), with 10 ppm sea salt ingestion and fuel containing approximately 1 ppm sulfur, was encouraging since it indicated that the alloy exhibited adequate corrosion resistance. However, the overall results of the test were not conclusive since the relatively low chromium containing alloy, CMSX-3 alloy, exhibited surprisingly good resistance to attack relative to the CMSX-11 material.

TABLE 5

899° C. (1650° F.) HOT CORROSION (BURNER RIG.)

| Alloy | Average Depth of Corrosion Attack After 117 Hours |
|---|---|
| CMSX-11 | 5 mils |
| CMSX-3 | 2 mils |
| CMSX-4 | 1 mil |
| Mar M 247 | 10 mils |
| CMSX-10C | 9 mils |

Additional Test Conditions
- 1% Sulfur Content in Gas Stream
- 10 ppm Sea Salt Injestion Following the aforementioned evaluations, a modified composition, designated CMSX-11A in Table 1, was derived and produced. Rather than producing another 250 lb. (113 kg.) heat of the aim composition, it was formulated during the investment casting process by melting/blending 22 lbs. (10 kg.) of the VF 839 product with 4 lbs. (1.8 kg.) of virgin elemental material.

Sixteen each single crystal test bars were produced, with similar yields prevailing as achieved with CMSX-11 alloy. A test bar chemistry check indicated that adequate aim chemistry was attained. Full coarse $\gamma'$ and eutectic $\gamma$-$\gamma'$ solutioning was achieved by using a peak soak temperature of 2293° F. (1256° C.). Test specimen aging treatments were applied as reported in Table 3 above, and several fully heat treated test bars were machined/ground to proportional creep test specimen dimension. Alloy strength was checked by subjecting the resulting test specimens to test conditions ranging 1400° F.–1800° F. (760°– 982° C.). The results are reported in Table 6 below.

Failed test specimen microstructural review indicated that the CMSX-11A composition was a microstructurally unstable design based on varying levels of TCP sigma needle phase formation observed in some of the respective cross-sections. For this reason, plus the unacceptably low level of strength observed, the CMSX-11A composition was further modified in an attempt to achieve greater creep-rupture strength and improved phasial stability.

With the CMSX-11A alloy $Nv_{3e}$ phasial stability number calculated at 2.52 and the CMSX-11 test bar $N_{v3B}$ phasial stability number calculated at 2.39, the next compositional trial was aimed at achieving a 2.42 $N_{v3B}$ level in order to obtain the desired strength level.

Table 2 above reports the CMSX-11B aim composition. Since the Al+Ti level of the CMSX-11A composition allowed for complete solutioning, the CMSX-11B Al+Ti level was designed to remain the same. Phasial stability was sought to be improved primarily through the reduction of Cr and Co, while the adequate solution heat treatment characteristic was fortified through further reduction of Cb alloying.

Since it appeared that several more alloy iterations might be required before achieving the desired result, another approach was taken toward test specimen manufacture. This alternate approach consisted of manufacturing a lean base composition which could be used in varying combination with virgin elemental materials toward formulating CMSX-11B alloys with small chemistry differences. The resulting "lean-alloy" composition was designated R2D2 and a 250 lb. (113 kg.) VIM heat, VF 952 (See Table 2 above), was produced.

Twenty-three pounds of the R2D2 alloy composition was combined with three lbs. of virgin elemental addition to produce the CMSX-11B aim composition reported in Table 1 above. A test bar chemistry check indicated adequate chemistry attainment. This particular mold produced thirteen each single crystal test bars along with three each, small single crystal turbine blades. Test bar and blade grain yield was 100%, while all Laue results showed the test specimens within 10° of the desired primary (001) crystallographic orientation.

TABLE 6

CREEP-RUPTURE DATA
CMSX-11A Alloy

| | RUPTURE TIME | EL | RA | FINAL CREEP READING | | TIME IN HRS TO REACH | |
|---|---|---|---|---|---|---|---|
| TEST CONDITION | HRS | % | % | T, HRS | % DEFORMATION | 1.0% | 2.0% |
| 1400° F./90.0 ksi | 1786.4 | 12.5 | 23.9 | 1785.1 | 12.333 | 76.7 | 409.5 |
| (760° C./620 mpa) | 2297.5 | 13.5 | 18.4 | 2296.7 | 13.211 | 101.6 | 487.6 |
| | 2150.7 | 16.1 | 23.8 | 2150.6 | 15.840 | 136.4 | 578.4 |
| | — | — | — | — | — | 85.1 | — |
| 1600° F./50.0 ksi | 932.0 | 25.3 | 34.7 | 931.3 | 23.936 | 123.8 | 351.8 |
| (871° C./345 MPa) | 946.3 | 16.0 | 26.8 | 945.2 | 15.947 | 136.9 | 378.2 |
| | — | — | — | — | — | 89.7 | 315.5 |
| | 971.8 | 18.7 | 29.8 | 970.9 | 18.285 | 128.9 | 374.5 |
| 1700° F./36.0 ksi | 636.4 | 25.3 | 43.7 | 634.8 | 22.510 | 71.6 | 232.6 |
| (927° C./248 MPa) | — | — | — | — | — | 128.4 | 307.1 |
| 1800° F./25.0 ksi | 452.7 | 20.6 | 34.8 | 452.5 | 20.160 | 154.6 | 282.9 |
| (932° C./172 MPa) | 432.3 | 22.1 | 41.6 | 431.6 | 19.417 | 138.5 | 278.5 |
| | 439.1 | 23.4 | 47.3 | 436.9 | 23.050 | 141.1 | 277.5 |

+ Machined From Blade Specimen (Airfoil)
++ Machined From Blade Specimen (Transverse Root)

Concurrent to this, quantities of VF 952+virgin elemental addition (to produce CMSX-11B alloy) were investment cast to produce twelve single crystal test bars and twelve single crystal blades. All the molds used to produce these products exhibited 100% grain yield and all the specimens were controlled to within 5° of the desired primary (001) crystallographic orientation.

A chemistry check of the CMSX-11B test materials after they were investment cast revealed that adequate chemistry attainment was achieved. Solution heat treatment trials revealed that the materials could be 100% solutioned when given a final soak at 2300° F. (1260° C.).

Following solution treatment, several test bar specimens were utilized to determine the effect of varied primary aging treatment. This investigation indicated that a 5 hour soak at 2050° F. (1121° C.) resulted in a more preferred arrangement and optimally sized (approximately 0.5 μm) γ' precipitate than the previously employed primary age at 1975° F. (1079° C.)/4 Hr./AC. Lower temperature aging remained the same as previously employed, which is detailed in Table 3 above.

Moderate quantities of CMSX-11B test bars and test blades were prepared for creep-rupture testing. They were fully heat treated as detailed in Table 3 above. Longitudinal proportional creep specimens, generally 0.125" gage diameter, were prepared with the single crystal test bars, while longitudinal airfoil and transverse root section specimens of 0.070" gage diameter were extracted from the test blades.

The specimens were subjected to stress-and creep-rupture testing at temperature ranging 1400°–1800° F. (760°–982° C.). Since the initial results of these tests were encouraging, the testing program was expanded to include temperature/stress conditions up to 1900° F. (1038° C.). The results of these tests are reported in Table 7 below.

TABLE 7

STRESS- AND CREEP-RUPTURE DATA
CMSX-11B, -11B' and -11B" Alloy

| TEST CONDITION | | RUPTURE TIME HRS | EL % | RA % | FINAL CREEP READING T, HRS | FINAL CREEP READING % DEFORMATION | TIME IN HRS TO REACH 1.0% | TIME IN HRS TO REACH 2.0% |
|---|---|---|---|---|---|---|---|---|
| 1400° F./90.0 ksi | | 2894.9 | 10.7 | 12.6 | 2891.4 | 7.716 | 603.4 | 1307.4 |
| (760° C./620 MPa) | | 3015.5 | 11.2 | 11.4 | 3015.3 | 10.121 | 465.8 | 1222.3 |
| | | 2904.2 | 10.7 | 13.6 | 2901.9 | 9.741 | 226.0 | 962.5 |
| | | 3230.4 | 11.7 | 15.3 | 3230.3 | 11.382 | 287.2 | 921.5 |
| | + | 1377.4 | 12.7 | 20.4 | — | — | — | — |
| | + | 1847.4 | 12.7 | 20.4 | — | — | — | — |
| | ++ | 1224.2 | 9.8 | 9.7 | — | — | — | — |
| | ++ | 178.0 | 2.0 | 2.6 | — | — | — | — |
| 1400° F./95.0 ksi | | 1728.5 | 12.2 | 20.4 | 1726.7 | 11.790 | 198.0 | 534.9 |
| (760° C./655 MPa) | | 1738.4 | 5.9 | 6.2 | 1734.4 | 4.616 | 383.0 | 1107.9 |
| | | 2022.2 | 7.0 | 9.1 | 2020.4 | 6.386 | 384.8 | 1209.7 |
| | | 1750.2 | 4.2 | 5.0 | 1747.0 | 3.872 | 572.3 | 1253.4 |
| | * | 787.6 | 21.2 | 26.7 | 787.1 | 18.535 | 139.6 | 298.2 |
| 1600° F./50.0 ksi | | 2082.7 | 12.3 | 23.7 | 2081.6 | 10.960 | 565.5 | 1111.2 |
| (871° C./345 MPa) | | 2181.9 | 16.5 | 20.4 | 2181.5 | 13.709 | 555.8 | 1115.4 |
| | | 1979.6 | 13.5 | 18.1 | 1979.0 | 12.556 | 461.2 | 956.4 |
| | | 1865.1 | 20.7 | 30.3 | 1864.1 | 20.070 | 426.4 | 904.5 |
| 1600° F./55.0 ksi | | 821.6 | 17.1 | 33.0 | 821.2 | 16.03 | 166.4 | 382.3 |
| (871° C./379 MPa) | + | 862.4 | 14.2 | 18.5 | — | — | — | — |
| | + | 906.0 | 16.8 | 20.1 | — | — | — | — |
| | ++ | 650.8 | 12.7 | 14.9 | — | — | — | — |
| | ++ | 733.6 | 15.0 | 16.2 | — | — | — | — |
| | | 497.9 | 11.3 | 16.7 | 497.0 | 9.752 | 282.0 | 404.8 |
| | | 457.1 | 9.6 | 17.1 | 456.7 | 6.980 | 267.9 | 385.6 |
| | | 530.5 | 10.9 | 12.2 | 530.3 | 9.881 | 236.4 | 391.5 |
| | | 511.9 | 8.2 | 16.2 | 511.0 | 6.903 | 241.8 | 401.3 |
| | | 587.4 | 11.3 | 13.7 | 587.3 | 10.621 | 251.6 | 444.3 |
| | | 546.2 | 10.6 | 13.7 | 545.2 | 8.582 | 296.6 | 438.2 |
| | ** | 944.0 | 11.3 | 27.2 | 943.8 | 9.989 | 250.6 | 527.9 |
| 1650° F./45.0 ksi | | 1186.6 | 19.2 | 19.8 | 1186.5 | 17.496 | 299.7 | 584.7 |
| 899° C./310 MPa) | | 1081.1 | 21.8 | 21.8 | 1080.6 | 15.078 | 61.9 | 290.9 |
| | | 1062.7 | 22.3 | 37.5 | 1061.9 | 20.057 | 170.6 | 447.7 |
| | | 996.2 | 14.4 | 35.7 | 996.1 | 13.238 | 230.2 | 511.4 |
| | + | 867.4 | — | 14.2 | — | — | — | — |
| | + | 802.5 | 17.2 | 15.7 | — | — | — | — |
| | ++ | 702.4 | — | 16.9 | — | — | — | — |
| | ++ | 762.3 | 13.0 | 14.0 | — | — | — | — |
| | | 481.0 | 11.6 | 20.7 | 480.8 | 9.609 | 274.6 | 399.2 |
| | | 511.3 | 10.5 | 15.9 | 510.7 | 7.800 | 329.4 | 430.5 |
| | | 569.4 | 14.0 | 15.7 | 568.9 | 12.909 | 209.2 | 430.7 |
| | | 597.1 | 10.2 | 13.5 | 596.8 | 8.494 | 341.5 | 484.8 |
| | | 592.7 | 10.3 | 15.9 | 592.5 | 9.253 | 332.9 | 478.4 |
| | * | 1094.3 | 11.3 | 14.6 | iO94.2 | 10.095 | 260.1 | 576.8 |
| | * | 1263.1 | 11.9 | 20.0 | 1261.9 | 11.148 | 390.2 | 697.6 |
| | ** | 1184.9 | 16.0 | 27.5 | 1183.6 | 14.302 | 295.3 | 609.3 |
| 1700° F./36.0 ksi | | 1400.4 | 19.8 | 30.0 | 1398.8 | 17.253 | 375.7 | 774.3 |
| (927° C./248 MPa) | | 1329.0 | 20.4 | 35.3 | 1326.7 | 18.178 | 391.4 | 774.3 |
| | | 1223.2 | 17.0 | 31.3 | 1223.2 | 12.760 | 357.2 | 751.3 |
| | | 1160.1 | 20.6 | 34.7 | 1158.9 | 18.937 | 251.9 | 608.7 |

TABLE 7-continued

STRESS- AND CREEP-RUPTURE DATA
CMSX-11B, -11B' and -11B" Alloy

| TEST CONDITION | | RUPTURE TIME HRS | EL % | RA % | FINAL CREEP READING T, HRS | FINAL CREEP READING % DEFORMATION | TIME IN HRS TO REACH 1.0% | TIME IN HRS TO REACH 2.0% |
|---|---|---|---|---|---|---|---|---|
| | | 1117.8 | 16.9 | 4.9 | 1116.2 | 14.806 | 293.4 | 614.8 |
| | + | 698.3 | — | 17.1 | — | — | — | — |
| | + | 651.1 | 19.3 | 19.0 | — | — | — | — |
| | ++ | 647.9 | — | 15.7 | — | — | — | — |
| | ++ | 857.2 | 16.8 | 19.5 | — | — | — | — |
| | | 619.7 | 14.4 | 14.8 | 618.7 | 12.775 | 324.4 | 497.4 |
| | | 610.3 | 11.7 | 22.4 | 608.9 | 8.909 | 385.3 | 508.8 |
| | * | 1457.8 | 9.1 | 23.8 | 1457.8 | 8.345 | 499.7 | 946.4 |
| | ** | 927.8 | 10.8 | 33.8 | 925.9 | 8.523 | 347.5 | 628.4 |
| 1750° F./20.0 ksi | | 7513.2 | 14.0 | 30.1 | 7511.8 | 12.133 | 2482.2 | 5867.6 |
| (954° C./138 MPa) | | 7597.3 | 11.9 | 18.0 | 7595.9 | 8.979 | 3808.1 | 6805.0 |
| 1750° F./30.0 ksi | | 983.1 | 27.4 | 37.8 | 983.0 | 22.796 | 290.4 | 570.2 |
| (954° C./207 MPa) | | 963.5 | 17.0 | 41.0 | 963.3 | 15.599 | 298.0 | 584.1 |
| | + | 450.5 | 9.0 | 6.2 | — | — | — | — |
| | + | 439.3 | 9.5 | 12.6 | — | — | — | |
| | ++ | 755.4 | 19.1 | 23.5 | — | — | — | |
| | ++ | 666.6 | 14.4 | 17.6 | — | — | — | — |
| | | 600.4 | 8.7 | 12.8 | 600.3 | 7.395 | 256.9 | 494.5 |
| | | 750.3 | 8.5 | 15.6 | 748.0 | 7.775 | 117.7 | 534.1 |
| | | 814.6 | 7.9 | 16.1 | 812.9 | 7.810 | 77.6 | 449.6 |
| | | 637.4 | 12.0 | 20.2 | 635.8 | 6.626 | 355.5 | 527.1 |
| | | 706.8 | 12.1 | 17.1 | 705.1 | 9.224 | 276.5 | 567.1 |
| | | 795.4 | 8.2 | 20.5 | 744.6 | 6.704 | 490.9 | 700.7 |
| | * | 1332.2 | 15.8 | 38.9 | 1330.6 | 13.489 | 436.0 | 905.6 |
| | * | 1893.2 | 12.5 | 35.4 | 1849.3 | 6.916 | 468.7 | 1306.2 |
| | ** | 1123.9 | 11.8 | 26.9 | 1123.5 | 9.099 | 341.2 | 801.2 |
| 1800° F./25.0 ksi | | 1260.2 | 13.8 | 17.0 | 1258.7 | 11.168 | 504.1 | 1099.7 |
| (982° C./172 MPa) | | 1209.8 | 12.1 | 38.0 | 1208.3 | 9.513 | 87.2 | 700.1 |
| | | 1198.1 | 12.7 | 35.4 | 1196.0 | 9.402 | 322.7 | 967.7 |
| | | 894.3 | 25.0 | 52.0 | 849.3 | 21.816 | 345.1 | 601.2 |
| | | 803.8 | 16.4 | 47.4 | 803.8 | 13.215 | 318.2 | 571.3 |
| | + | 556.0 | 11.5 | 19.7 | — | — | — | — |
| | + | 714.9 | — | 19.5 | — | — | — | — |
| | ++ | 490.0 | — | 21.4 | — | — | — | — |
| | ++ | 545.0 | 41.7 | 32.7 | — | — | — | — |
| | | 1120.2 | 8.0 | 25.2 | 1120.2 | 5.517 | 548.2 | 1023.3 |
| | | 1186.3 | 16.8 | 28.3 | 1185.2 | 14.190 | 354.3 | 960.3 |
| | | 1263.8 | 15.3 | 27.8 | 1262.8 | 8.445 | 903.7 | 1143.8 |
| | | 1343.4 | 10.2 | 23.6 | 1342.4 | 6.627 | 940.8 | 1239.7 |
| | | 1181.3 | 17.7 | 26.4 | 1180.1 | 12.169 | 745.5 | 1043.0 |
| | | 1190.9 | 15.7 | 31.2 | 1189.4 | 12.937 | 537.3 | 981.5 |
| | * | 1583.3 | 13.3 | 33.9 | 1581.6 | 10.411 | 462.2 | 1289.6 |
| | * | 1637.0 | 9.7 | 41.6 | 1636.1 | 7.942 | 246.9 | 1158.1 |
| | * | 1819.8 | 7.4 | 37.1 | 1817.8 | 5.683 | 664.6 | 1631.8 |
| | * | 1901.7 | 8.0 | 37.9 | 1897.4 | 5.124 | 682.8 | 1739.8 |
| | ** | 990.4 | 9.5 | 30.8 | 989.2 | 6.917 | 432.3 | 839.7 |
| 1850° F./25.0 ksi | * | 469.5 | 7.0 | 20.7 | 465.8 | 2.772 | 335.2 | 458.1 |
| (1010° C./172 MPa) | * | 541.0 | 4.8 | 16.3 | 540.0 | 4.098 | 92.0 | 494.4 |
| | * | 806.2 | 9.4 | 44.1 | 806.1 | 5.943 | 248.6 | 709.8 |
| | * | 993.5 | 8.2 | 36.1 | 993.1 | 5.847 | 141.9 | 872.7 |
| | ** | 430.1 | 8.0 | 36.0 | 429.6 | 6.770 | 172.2 | 374.8 |
| 1850° F./15.0 ksi | * | Running at 44.09.6 Hrs., 1.476% Deformation | | | | | 1709.4 | |
| (1010° C./103 MPa) | * | Running at 4204.6 Hrs., .898% Deformation | | | | | | |
| | ** | Running at 1591.0 Hrs., .314% Deformation | | | | | | |
| 1900° F./18.0 ksi | | 2659.2 | 9.3 | 18.4 | 2654.2 | 4.226 | 257.2 | 1881.1 |
| (1038° C./124 MPa) | | 2677.5 | 6.8 | 15.0 | 2670.4 | 3.212 | 528.2 | 2495.1 |
| | | 2762.5 | 7.0 | 16.8 | 2762.0 | 4.240 | 316.6 | 2713.7 |
| | | 1545.7 | 7.9 | 23.6 | 1545.4 | 5.467 | 292.3 | 1386.5 |
| | | 960.2 | 8.4 | 30.7 | 959.0 | 6.627 | 369.3 | 818.9 |
| | | 2602.8 | 6.6 | 16.1 | 2602.6 | 4.972 | 624.3 | 2550.5 |
| | * | 3067.6 | 5.2 | 22.9 | 3060.9 | 4.424 | 347.8 | 1169.4 |
| | ** | 918.2 | 5.8 | 32.8 | 917.5 | 3.140 | 886.6 | 910.4 |

+ Machined From Blade Specimen (Airfoil)
++ Machined From Blade Specimen (Transverse Root)
* CMSX-11B' Alloy
** CMSX-11B" Alloy
All results are for the CMSX-11B Alloy except where otherwise specifide With the stress-and creep-rupture results continuing to be favorable, two more 250 lb. (113 kg.) VIM heats of the CMSX-11B composition were produced. The heat identities for the two heats are VF 999 and VG 32, and their respective compositions are detailed in Table 2.

Material from these heats was then used to produce additional investment cast test bars and blades. A chemistry check of the test materials indicated adequate chemistry attainment. Perfect single crystal grain yield prevailed for some of this product, and heat treat processing of the specimens yielded similar results to previous experience.

Further mechanical property testing was undertaken with some of the test product, the results of which are reported in Table 7 above. Concurrent to this activity, fully heat treated specimens of CMSX-11B alloy were subjected to oxidation and hot corrosion testing.

The results of hot corrosion tests performed are presented in Table 8 below. The tests were undertaken at 700° C. (1292° F.) and 800° C. (1472° F.) in a laboratory furnace utilizing an artificial ash plus $SO_2$. Metal loss data are reported as mean and maximum values, as well as a percentage loss of the test pin employed. Data are reported for intervals of 100, 576 and 1056 hours for the 700° C. (1292° F.) test, and 100, 576, 1056 and 5000 hours for the 800° C. (1472° F.) test.

TABLE 8

CMSX-11B HOT CORROSION

| EXPOSURE TIME (Hrs) | METAL LOSS (microns) MEAN VAL. | MAX. VAL. | PERCENTAGE METAL LOSS |
|---|---|---|---|
| TEST TEMPERATURE (°C.) 700 | | | |
| 100 | 2 | 9.5 | 0.16 |
| 576 | 50 | 62 | 3.98 |
| 1056 | 42 | 71 | 3.41 |
| 5000 | | | |
| TEST TEMPERATURE (°C.) 800 | | | |
| 100 | 257.5 | 475.5 | 19.58 |
| 576 | 2494.5 | 2494.5 | 100.00 |
| 1056 | 2494.5 | 2494.5 | 100.00 |
| 5000 | 2494.5 | 2494.5 | 100.00 |

Similarly, FIG. 1 illustrates the results of additional hot corrosion tests undertaken with CMSX-11B alloy and other alloys to 500 hours exposure in synthetic slag (GTV Type) plus 0.03 volume percent $SO_x$ in air. The 500 hour tests were undertaken at 750°, 850° and 900° C. (1382°, 1562°, 1652° F.). These results indicate that the CMSX-11B alloy provides extremely good corrosion resistance at all three test temperatures.

Subsequent testing utilizing an alternative slag, type FVV, with test temperatures of 800° C. and 900° C. (1472°, 1652° F.), was also undertaken. The 500 hour test results are reported in Table 9 below.

TABLE 9

CMSX-11B ALLOY vs. IN 738 LC ALLOY HOT CORROSION
Results presented represent depth of penetration after 500 hours exposure in synthetic slag (type FVV) plus 0.03% $SO_x$ in air.

| Alloy | Maximum Penetration | Average Penetration |
|---|---|---|
| Test Temperature - 800° C. (1472° F.) | | |
| CMSX-11B | 350 μm | 170 μm |

TABLE 9-continued

CMSX-11B ALLOY vs. IN 738 LC ALLOY HOT CORROSION
Results presented represent depth of penetration after 500 hours exposure in synthetic slag (type FVV) plus 0.03% $SO_x$ in air.

| Alloy | Maximum Penetration | Average Penetration |
|---|---|---|
| Test Temperature - 900° C. (1652° F.) | | |
| CMSX-11B | 220 μm | 150 μm |
| IN 738 LC | — | 190 μm |

Figure 2:
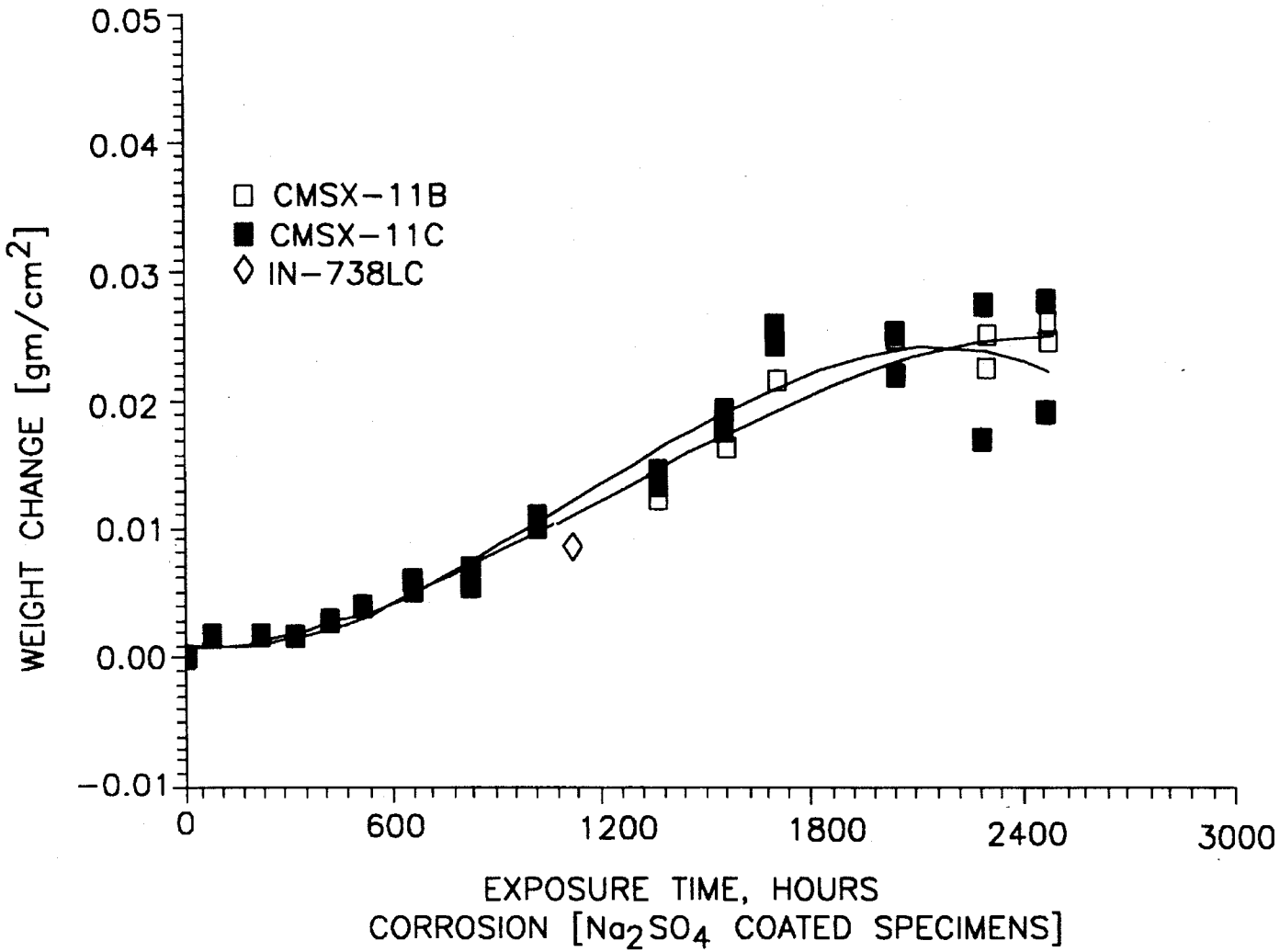
FIG. 2 is a graphical comparison of hot corrosion data from tests performed at 732° C. (1350° F.) on one embodiment of this invention and on two other alloys.
Figure 3:
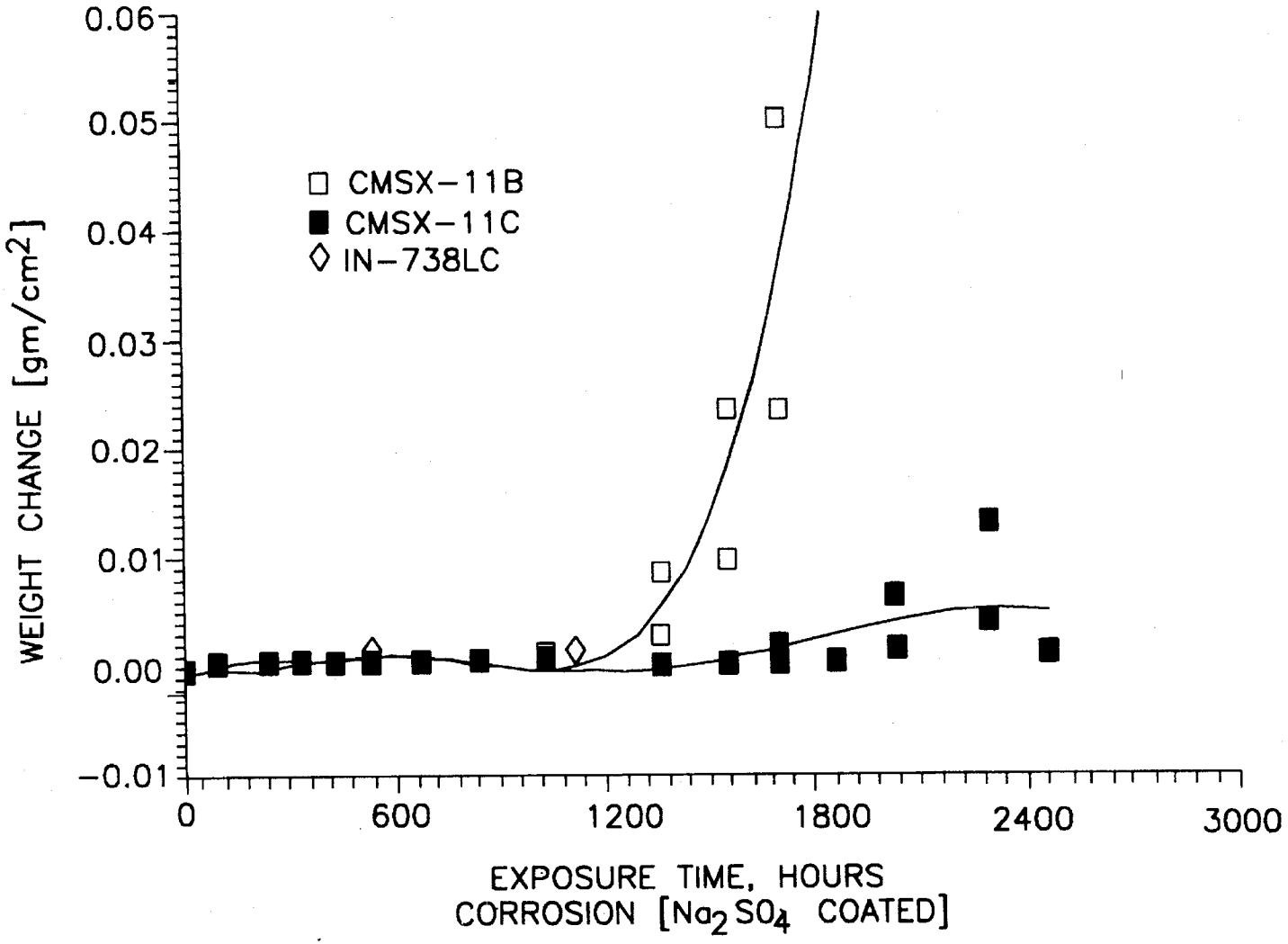
FIG. 3 is a graphical comparison of hot corrosion data from tests performed at 899° C. (1650° F.) on one embodiment of this invention and on two other alloys.

Additional laboratory furnace, crucible type, artificial ash hot corrosion tests were performed. The results of these tests, undertaken at 732° C. (1350° F.) and 899° C. (1650° F.), are illustrated in FIGS. 2 and 3, respectively. In these tests, the specimens were coated with 1 mg./cm$^2$ $Na_2SO_4$ every 100 cycles and were cycled 3 times per day. The test at 732° C. was run to about 2400 hours while the one at 899° C. was taken to about 1800 hours.

Further hot corrosion tests were performed with the CMSX-11B alloy. In contrast to the aforementioned tests, the hot corrosion evaluations subsequently undertaken were performed in burner rigs, which is usually a preferred method of testing since the results achieved in burner rig tests generally give more representative indications of the way materials will perform in a gas turbine engine.

The burner rig tests were performed at 900° C. (1652° F.) and 1050° C. (1922° F.), and the test results are reported below in Tables 10 and 11, respectively. The 9 mm diameter×100 mm long test pins utilized were mounted in a rotating cylindrical jig and exposed to a high speed gas stream. Other test conditions are specified in the respective Tables.

TABLE 10

900° C. (1652° F.) HOT CORROSION (BURNER RIG.)

| ALLOY | | Weight Loss In Grams As a Function of Time 100 | 200 | 300 | 400 | 500 Hrs. |
|---|---|---|---|---|---|---|
| CMSX-11B | ** | .005 | .015 | .01 | −.01 | .03 |
| CMSX-11C | ** | .04 | .005 | −.015 | −.045 | .013 |
| FSX 414 | * | .015 | .045 | .04 | .04 | .085 |
| RENE 80 H | * | .075 | .275 | .365 | .46 | .495 |
| IN 738 LC | * | .015 | .08 | .10 | .15 | .195 |
| IN 939 | * | −.07 | −.09 | −.14 | −.15 | −.06 |
| CH 186 LC ® | * | .08 | .195 | .30 | .395 | .44 |

* DS Columnar
** Single Crystal
CONDITIONS

| | | |
|---|---|---|
| 1 | temperature, time | 900° C. - 500 hrs (max) |
| 2 | burning gas flow rate | 6 Nm$^3$/min. |
| 3 | petroleum flow rate | 9 l/hr. |
| 4 | salt water | 6 cc/min. |
| 5 | sulfuric oil | 6 cc/min. |

TABLE 11

1050° C. (1922° F.) HOT CORROSION (BURNER RIG.)

| ALLOY | | Weight Loss In Grams As a Function of Time 100 | 200 | 300 | 400 | 500 Hrs. |
|---|---|---|---|---|---|---|
| CMSX-11B | ** | 0.1 | 0.7 | 1.15 | 2.5 | — |

TABLE 11-continued

| 1050° C. (1922° F.) HOT CORROSION (BURNER RIG.) | | | | | | |
|---|---|---|---|---|---|---|
| | | Weight Loss In Grams As a Function of Time | | | | |
| ALLOY | | 100 | 200 | 300 | 400 | 500 Hrs. |
| CMSX-11C | ** | 0.04 | 0.05 | 1.22 | 1.55 | 1.65 |
| FSX 414 | * | 0.2 | 0.39 | 0.5 | 0.65 | 0.9 |
| RENE 80 H | * | 0.18 | 0.38 | 0.47 | 1.45 | 1.68 |
| IN 738 LC | * | 0.1 | 0.43 | 1.35 | 2.09 | 2.33 |
| IN 939 | * | 0.1 | 0.22 | 0.26 | 0.45 | 0.65 |
| CM 186 LC | * | 0.6 | 2.9 | — | — | 13.7 |

* DS Columnar
** Single Crystal

CONDITIONS

| | | | | |
|---|---|---|---|---|
| 1 | temperature, time | 1050° C. - 500 hrs (max) | | |
| 2 | burning gas flow rate | 6 $Nm^3$/min | $SO_x$ | 257~287 ppm |
| 3 | petroleum flow rate | 18 l/min | NaCl | 17.8~18.2 $mg/m^3$ |
| 4 | NaCl solution | 6 cc/min | $Na_2SO_4$ | <0.5 $mg/m^3$ |
| 5 | sulphuric oil | 7 cc/min | | |

Figure 4:
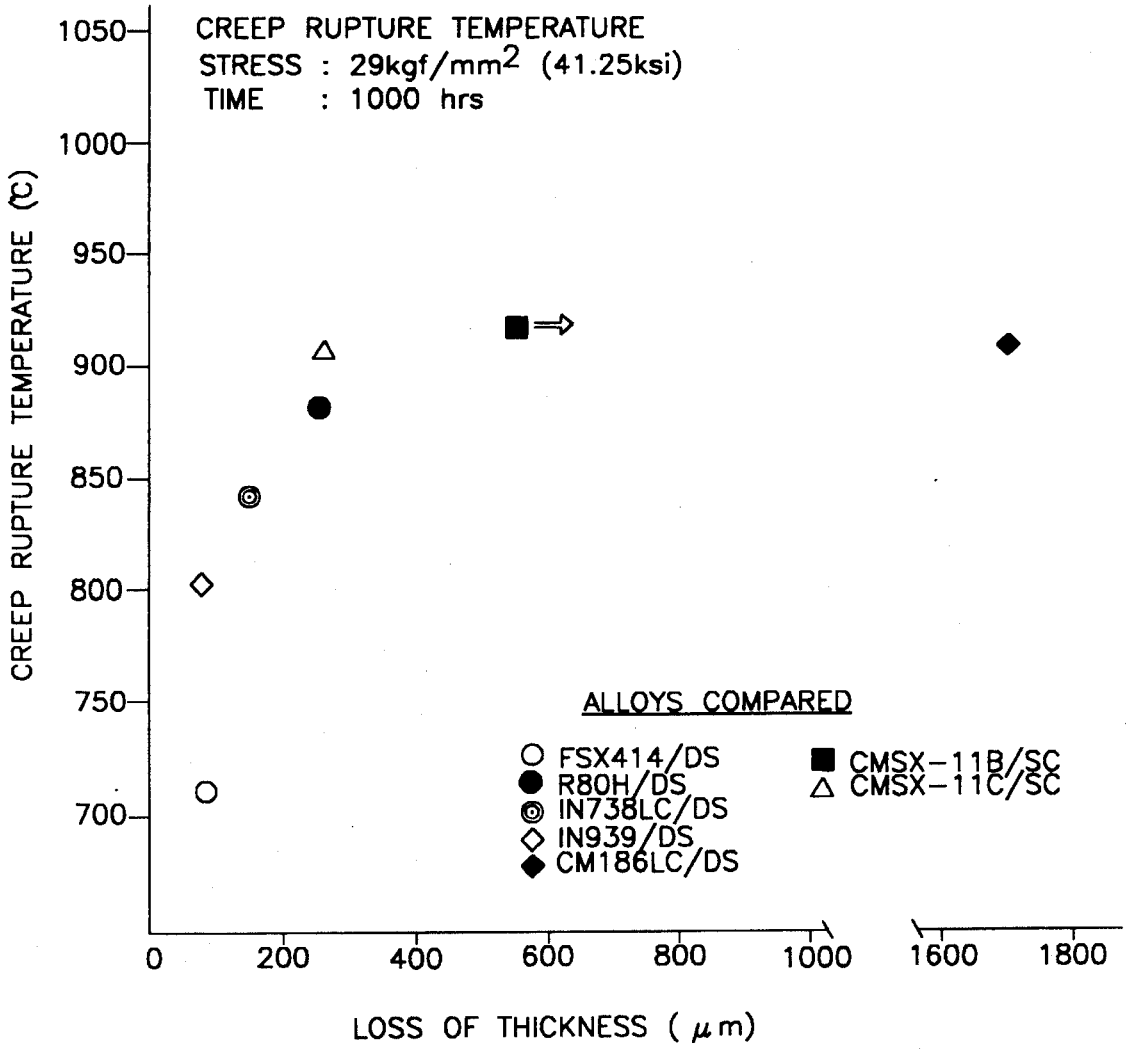
FIG. 4 is a graphical comparison of alloy strength and hot corrosion data from tests performed on one embodiment of this invention and on six other alloys.

Several alloys were evaluated within the same rig. The results indicate that CMSX-11B alloy provided much better hot corrosion resistance than IN 738 LC alloy at the 900° C. (1652° F.) test condition and similar capability at 1050° C. (1922° F.). Furthermore, FIG. 4 illustrates that CMSX-11B alloy provides an attractive blend of strength and hot corrosion resistance at 1050° C. (1922° F.). It is believed that a similar analysis at 900° C. would illustrate an even greater blend of capability.

CMSX-11B alloy oxidation tests were performed concurrent to the hot corrosion tests. Table 12 below reports the results of a laboratory furnace oxidation test performed at 950° C. (1742° F.) for 1000 hour duration. Mean and maximum oxidation depth plus weight gain measurements undertaken at 100 and 500 hour intervals are reported, as well as at test completion.

TABLE 12

| CMSX-11B HOT OXIDATION TEST TEMPERATURE (°C.) 950 | | | |
|---|---|---|---|
| EXPOSURE | OXIDATION DEPTH (MICRONS) | | WEIGHT GAIN |
| TIME (Hrs) | MEAN VAL. | MAX. VAL. | (GRAMS) |
| 100 | 3.5 | 18.2 | 1.80E-03 |
| 500 | 14.6 | 36.5 | 2.40E-03 |
| 1000 | 16.3 | 22.5 | 3.50E-03 |

Figure 5:
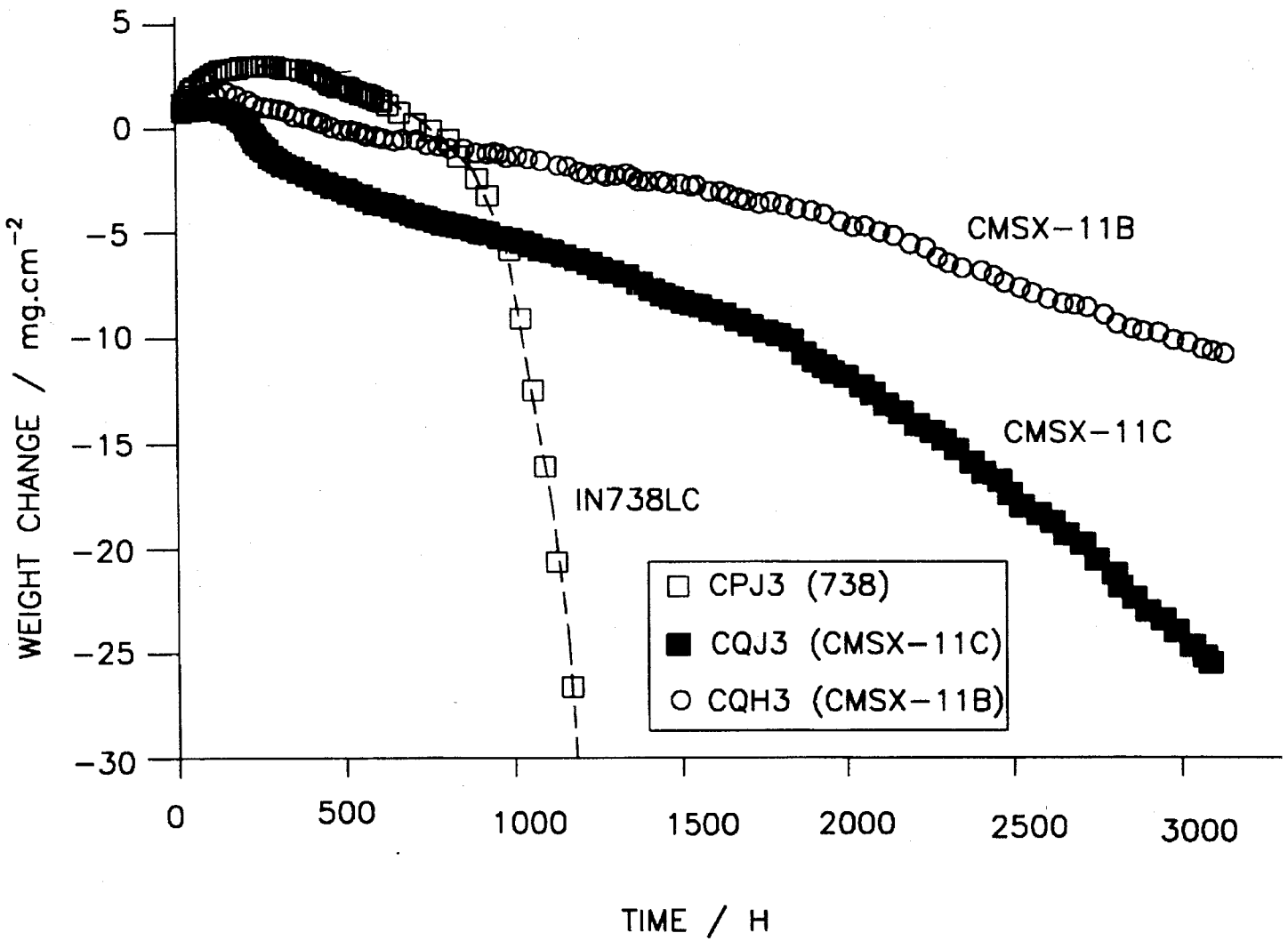
FIG. 5 is a graphical comparison of oxidation data from tests performed at 1000° C. (1832° F.) on one embodiment of this invention and on two other alloys.

FIG. 5 illustrates the results of 1000° C. (1832° F.) oxidation tests run to as long as 3000 hours. The tests which were performed in an air atmosphere, and measured test specimen weight change as a function of time. The test temperature was cycled to room temperature on a once-per-hour basis. The test results indicate that the CMSX-11B alloy provides much better oxidation resistance than IN 738 LC, an alloy which is widely used throughout the industrial turbine industry.

Figure 6:
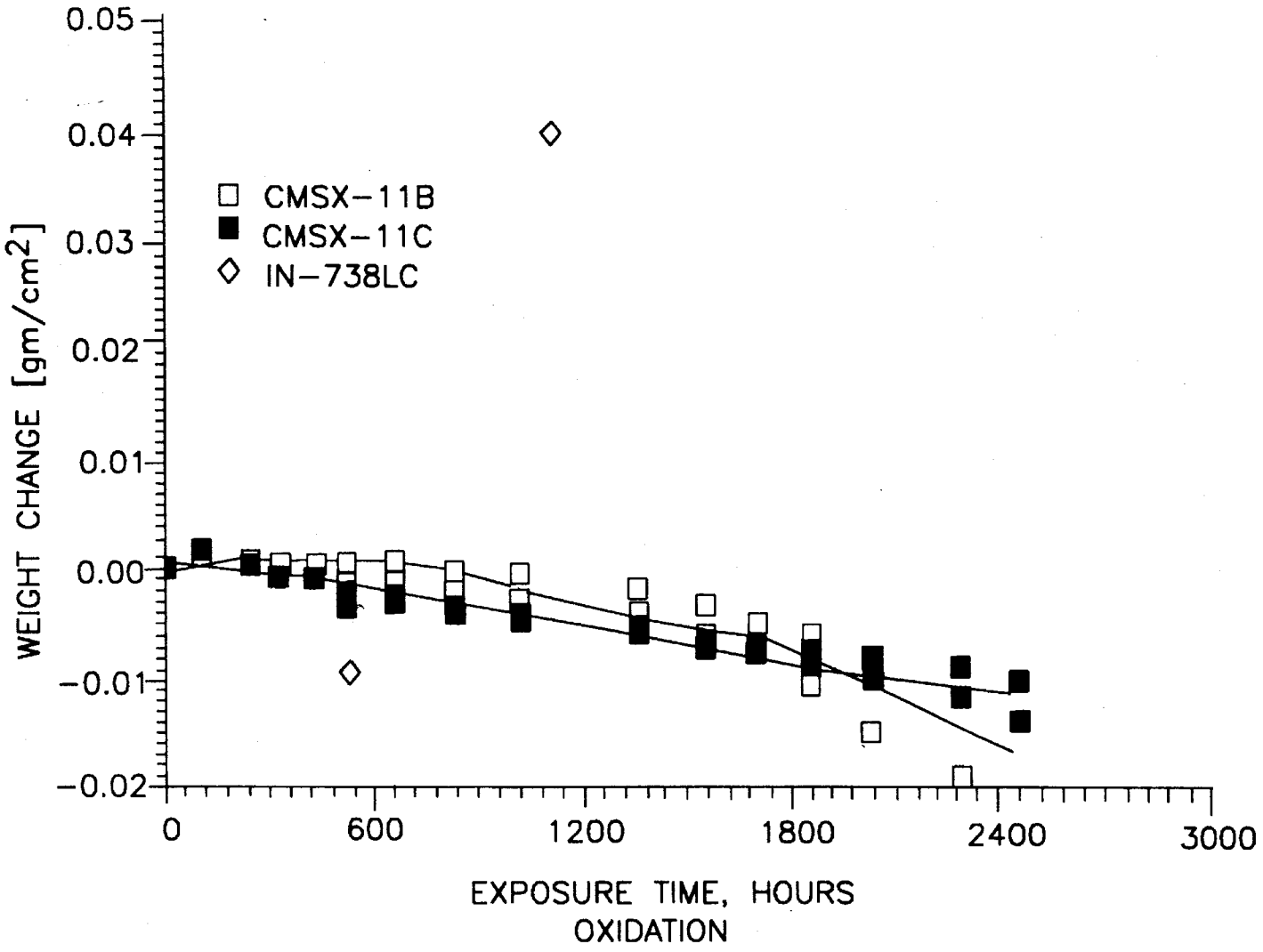
FIG. 6 is a graphical comparison of oxidation data from tests performed at 1010° C. (1850° F.) on one embodiment of the present invention and on two other alloys.

Further oxidation test results are illustrated in FIG. 6. In this particular test, the pins were cycled to room temperature 3 times per day from the 1010° C. (1850° F.) test temperature and weight change measured as a function of time. The test was run to about 2400 hours and the results indicate that the CMSX-11B material provides much better oxidation resistance than the alloy IN 738.

Burner rig oxidation testing was undertaken at 1200° C. (2192° F.), with the results presented in Table 13 below. Various alloys were tested within the same rotating carousel and specimen weight loss was measured at intervals of 100, 200, 300, 400 and 500 hours. Additional test conditions are provided in the Table.

TABLE 13

| 1200° C. (2192° F.) OXIDATION (BURNER RIG.) | | | | | | |
|---|---|---|---|---|---|---|
| | | Weight Loss In Grams As a Function of Time | | | | |
| ALLOY | | 100 | 200 | 300 | 400 | 500 Hrs. |
| CMSX-11B | ** | .002 | .005 | .011 | .012 | .026 |
| CMSX-11C | ** | .002 | .005 | .009 | .01 | .022 |
| FSX 414 | * | .02 | .077 | .085 | .12 | .125 |
| RENE 80 H | * | .002 | .005 | .014 | .20 | .35 |
| IN 738 LC | * | .005 | .034 | .049 | .064 | .095 |
| IN 939 | * | .016 | .038 | .064 | .077 | .113 |
| CM 186 LC | * | .002 | .01 | .01 | .015 | .013 |

* DS Columnar
** Single Crystal

CONDITIONS

| | | |
|---|---|---|
| 1 | temperature, time | 1200° C. - 500 hrs (max) |
| 2 | burning gas flow rate | 6 $Nm^3$/min |
| 3 | petroleum flow rate | 18~20 l/min |
| 4 | burning pressure | 11 $kgf/cm^2$ |

The burner rig oxidation test results illustrate that the CMSX-11B material provides extremely good 1200° C. (2192° F.) oxidation resistance in comparison to widely used industrial turbine blade and vane materials.

Figure 7:
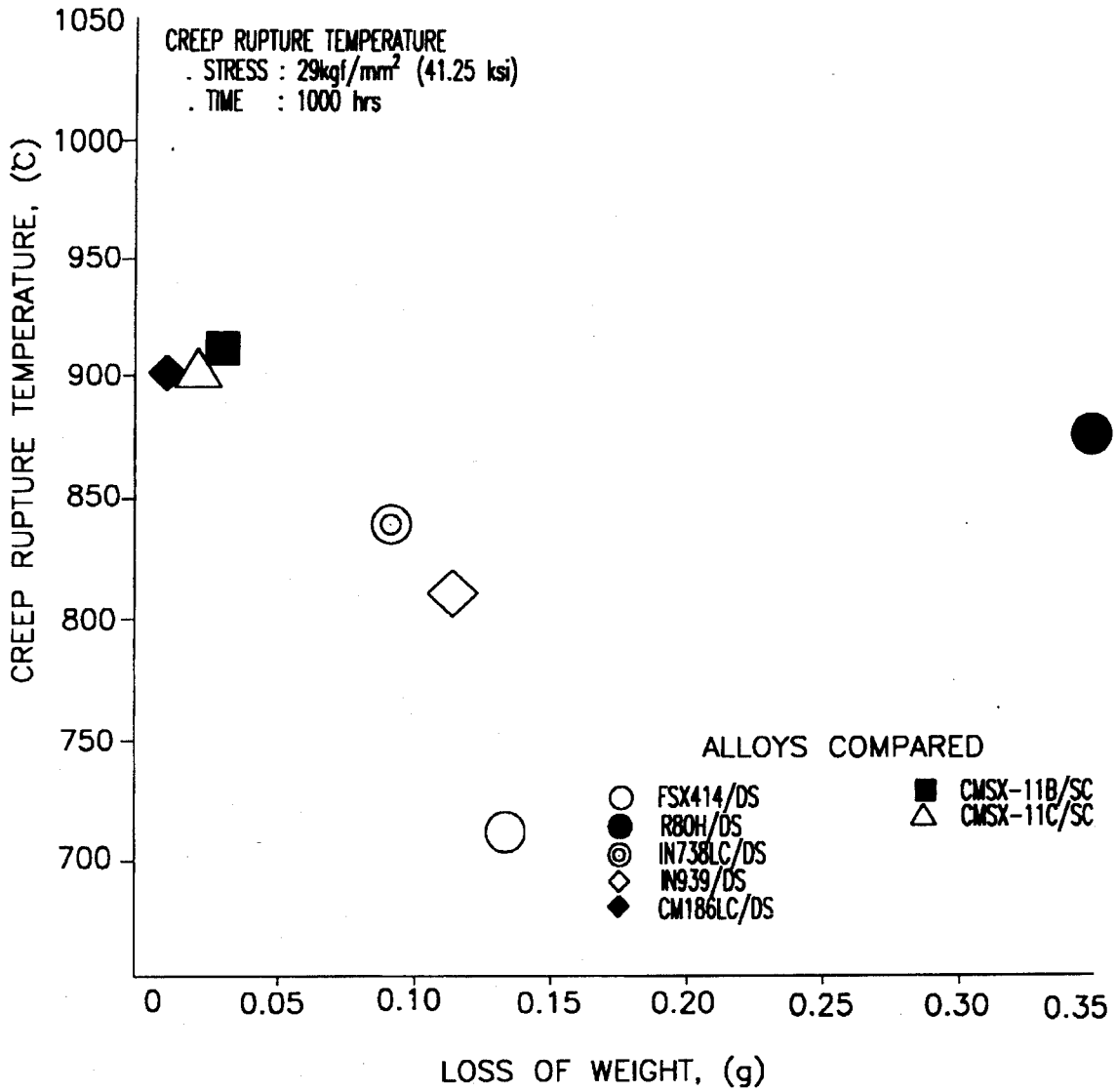
FIG. 7 is a graphical comparison of alloy strength and oxidation data from tests performed on one embodiment of this invention and on six other alloys.

An alloy strength and 1200° C. (2192° F.) oxidation comparison is illustrated in FIG. 7. This Figure illustrates that the CMSX-11B alloy blended capability is superior to directional solidified alloys such as René 80 H, FSX 414, IN 939 and IN 738 LC alloys.

Additional small VIM heats of the CMSX-11B alloy were produced subsequent to the aforementioned tests. The aim compositions for the CMSX-11B' and CMSX-11B" materials are reported in Table 1 above. These compositions were produced in order to explore the effects of small changes in the CMSX-11B alloy design. The chemistries achieved for the 270 lb. (122 kg.) heats produced are reported in Table 2 above, and identified with the respective heat numbers of VG 92 and VG 109. Quantities of these respective heats were investment cast to manufacture single crystal test bars. A chemistry check of the resulting bars indicated that adequate chemistry attainment was realized. Respective single crystal grain and orientation yields were 100% satisfactory, as experienced with the earlier alloy iterations.

Heat treatment trials led to the selection of a peak solution temperature of 1264° C. (2307° F.) for both alloys, as reported in Table 3 above. This resulted in solution levels of 99.5–100%. Aging treatments were applied as developed for CMSX-11B alloy.

Specimens were prepared for creep-rupture testing, and tests were undertaken at temperature ranging 760°–1038° C. (1400° F.–1900° F.). These test results are reported in Table 7 above, and appear to be improved relative to the CMSX-11B experience.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present information.

What is claimed is:

1. A hot corrosion resistant nickel-based superalloy comprising the following elements in percent by weight:

| | |
|---|---|
| Chromium | about 11.5–13.5 |
| Cobalt | about 5.5–8.5 |
| Molybdenum | about 0.40–0.55 |
| Tungsten | about 4.5–5.5 |
| Tantalum | about 4.5–5.8 |
| Columbium | about 0.05–0.25 |
| Aluminum | about 3.4–4.8 |
| Titanium | about 4.0–4.4 |
| Hafnium | about 0.01–0.06 |
| Nickel + Incidental Impurities | balance |

said superalloy having a phasial stability number $N_{V3B}$ less than about 2.45.

2. The superalloy of claim 1 further comprising the following elements in percent by weight:

| | |
|---|---|
| Carbon | about 0–0.05 |
| Boron | about 0–0.03 |
| Zirconium | about 0–0.03 |
| Rhenium | about 0–0.25 |
| Silicon | about 0–0.10 |
| Manganese | about 0–0.10. |

3. The superalloy of claim 1 wherein the sum of columbium plus hafnium is from 0.06 to 0.31 percent by weight.

4. The superalloy of claim 1 wherein the Ti:Al ratio is greater than 1.

5. The superalloy of claim 1 wherein the sum of aluminum plus titanium is from 7.4 to 8.2 percent by weight.

6. The superalloy of claim 1 wherein the Ta:W ratio is greater than 1.

7. The superalloy of claim 1 wherein said superalloy has an increased resistance to oxidation.

8. A single crystal article made from the superalloy of claim 1.

9. The single crystal article of claim 8 wherein the article is a component for a turbine engine.

10. The article of claim 9 wherein the component is a gas turbine blade or gas turbine vane.

11. A single crystal casting characterized by an increased resistance to hot corrosion, said casting being made from a nickel-based superalloy comprising the following elements in percent by weight:

| | |
|---|---|
| Chromium | 12.0–13.0 |
| Cobalt | 6.2–6.8 |
| Molybdenum | 0.42–0.48 |
| Tungsten | 4.7–5.3 |
| Tantalum | 4.9–5.5 |
| Columbium | 0.05–0.12 |
| Aluminum | 3.5–3.7 |
| Titanium | 4.1–4.3 |
| Hafnium | 0.02–0.05 |
| Nickel + Incidental Impurities | balance |

said superalloy having a phasial stability number $N_{V3B}$ less than about 2.45.

12. The single crystal casting of claim 11 further comprising the following elements in percent by weight:

| | |
|---|---|
| Carbon | 0–0.05 |
| Boron | 0–0.03 |
| Zirconium | 0–0.03 |
| Rhenium | 0–0.25 |
| Silicon | 0–0.10 |
| Manganese | 0–0.10. |

13. The single crystal casting of claim 11 wherein the sum of columbium plus hafnium is from 0.06 to 0.31 percent by weight.

14. The single crystal casting of claim 11 wherein the sum of aluminum plus titanium is from 7.4 to 8.2 percent by weight.

15. The single crystal casting of claim 11 wherein both the Ti:Al ratio and the Ta:W ratio are greater than 1.

16. The single crystal casting of claim 11 wherein said casting has an increased resistance to oxidation.

17. The single crystal casting of claim 11 wherein said casting has an increased creep-rupture strength.

18. The single crystal casting of claim 11 wherein said casting is a gas turbine blade or gas turbine vane.

19. A single crystal casting characterized by an increased resistance to hot corrosion, said casting being made from a nickel-based superalloy comprising the following elements in percent by weight:

| | |
|---|---|
| Chromium | about 12.5 |
| Cobalt | about 6.5 |
| Molybdenum | about 0.45 |
| Tungsten | about 5:0 |
| Tantalum | about 5.2 |
| Columbium | about 0.10 |
| Aluminum | about 3.60 |
| Titanium | about 4.2 |
| Hafnium | about 0.03 |
| Carbon | about 0–0.05 |
| Boron | about 0–0.03 |
| Zirconium | about 0–0.03 |
| Rhenium | about 0–0.25 |
| Silicon | about 0–0.10 |
| Manganese | about 0–0.10 |
| Nickel | balance |

said superalloy having a phasial stability number $N_{V3B}$ less than about 2.45, wherein the sum of columbium plus hafnium is from 0.06 to 0.31 percent by weight, the sum of aluminum plus titanium is from 7.4 to 8.2 percent by weight, the Ti:Al ratio is greater than 1, and the Ta:W ratio is greater than 1.

20. The single crystal casting of claim 19 wherein said casting is a gas turbine blade or gas turbine vane.

* * * * *